US010662054B2

(12) United States Patent
Dickinson

(10) Patent No.: US 10,662,054 B2
(45) Date of Patent: May 26, 2020

(54) REIN KEEPER

(71) Applicant: Booma Rein, Milford, NE (US)

(72) Inventor: Molly Ann Dickinson, Milford, NE (US)

(73) Assignee: BOOMA REIN, Milford, NE (US)

( * ) Notice: Subject to any disclaimer, the term of this patent is extended or adjusted under 35 U.S.C. 154(b) by 215 days.

(21) Appl. No.: 15/457,382

(22) Filed: Mar. 13, 2017

(65) Prior Publication Data

US 2017/0267514 A1 Sep. 21, 2017

Related U.S. Application Data

(60) Provisional application No. 62/309,554, filed on Mar. 17, 2016.

(51) Int. Cl.
*B68B 1/04* (2006.01)
*B68B 5/00* (2006.01)

(52) U.S. Cl.
CPC . *B68B 1/04* (2013.01); *B68B 5/00* (2013.01)

(58) Field of Classification Search
CPC ..... B68B 5/00; B68B 5/06; B68B 1/04
USPC ..... 54/16, 36, 71, 74
See application file for complete search history.

(56) References Cited

U.S. PATENT DOCUMENTS

| | | | | |
|---|---|---|---|---|
| 64,970 A | | 5/1867 | Bowden | |
| 372,362 A | | 11/1887 | Dannhauer | |
| 509,882 A | | 12/1893 | Easton | |
| 531,753 A | | 5/1895 | Smith | |
| 710,267 A | | 9/1902 | Graf | |
| 1,159,291 A | | 11/1915 | Telford | |
| 1,572,506 A | | 2/1926 | Renne | |
| 2,426,716 A | | 9/1947 | Telford | |
| 3,533,219 A | * | 10/1970 | Smith | B68B 1/04 54/35 |

(Continued)

FOREIGN PATENT DOCUMENTS

| | | | | |
|---|---|---|---|---|
| DE | 102006051407 A1 | * | 5/2008 | A01K 15/02 |
| GB | 2523409 A | | 8/2015 | |
| GB | 2523900 B | * | 4/2018 | |

OTHER PUBLICATIONS

Rein Safe, Slypner Gear, Retrieved from the Internet: https://store.slypnergear.com/rein-safe-p941.aspx on Jun. 15, 2017, 1 page.

(Continued)

*Primary Examiner* — David J Parsley
*Assistant Examiner* — Danielle A Clerkley
(74) *Attorney, Agent, or Firm* — Fredrikson & Byron, P.A.

(57) ABSTRACT

A horseback riding apparatus embodiment is described that includes a saddle mountable over a body of a horse, a bridle mountable over a head of a horse, a main rein connected to the bridle and a rein keeper connectable to the main rein and the saddle. The rein keeper has a first end, an elongated strap, and a second end opposite to the first end. The first end can be slidably connectable to the main rein, and the second end can be fixedly connectable to the saddle. The elongated strap has a strap length, wherein at least a portion of the strap length is extensible to allow a horse head to freely move between a raised position and a resting position and wherein the rein keeper is graspable by a rider seated on the saddle.

19 Claims, 5 Drawing Sheets

(56) References Cited

U.S. PATENT DOCUMENTS

| | | | | |
|---|---|---|---|---|
| 3,604,183 | A * | 9/1971 | Iseli | B68B 1/04 54/6.1 |
| 4,304,193 | A | 12/1981 | Madden | |
| 4,492,073 | A | 1/1985 | Finke | |
| 4,589,248 | A | 5/1986 | Rudlock | |
| 5,094,062 | A | 3/1992 | Clark | |
| 5,519,986 | A * | 5/1996 | Raffit | B68B 1/04 54/16 |
| 2010/0146913 | A1 * | 6/2010 | Roberts | B68B 1/00 54/71 |

OTHER PUBLICATIONS

Rein Safe, Action Rider Tack, Retrieved from the Internet: http://www.actionridertack.com/product-p/reinsafe.htm on Jun. 15, 2017, 3 pages.

Safety Rope as posted in public Facebook group entitled Diamond C Kids, Rodeo and Ridin Horses, Oct. 15, 2015, 1 page.

Safety Rope images as posted on Facebook, dated Oct. 15 & 16, 2015, 2 pages.

Safety Rope image as posted on Facebook, dated Mar. 2016, 1 page.

* cited by examiner

REIN KEEPER

BACKGROUND

Horseback riding typically involves controlling and steering the horse by way of horse riding equipment. In many cases, the riding equipment includes a bridle having a halter and a rein. The rein has its ends attached to ends of the halter while a rider holds a central portion of the rein to steer and control the horse. Typically, when a horse eats or drinks, the rider may drop a rein to allow the horse's head to have room to move towards the ground. Further, a rider may accidently drop a rein while the horse is in motion (e.g., if a horse trips and the rein is pulled from the rider's hand). Sometimes the rein falls over the horse's head and may not be retrieved by the rider without losing control and/or falling off of the horse. This may present a safety risk since it becomes difficult for the rider to reach and retrieve the rein, particularly if the horse is in motion. In such cases, the rider may lose control of the horse leading to accident or death. Further, additional reins that attach to the main rein near the horse's mouth would cause discomfort or injury to the horse if the rider were pull those, particularly if the horse's head is lowered. It would be desirable to provide safety features for riding equipment to allow a rider to be able to regain control of the rein while also allowing the horse to have sufficient freedom of movement.

SUMMARY

In one example, this disclosure is directed to a horseback riding apparatus including a saddle mountable over a body of a horse, a bridle mountable over a head of a horse, a main rein connected to the bridle and a rein keeper connectable to the main rein and the saddle.

In another example, the rein keeper has a first end, an elongated strap, and a second end opposite to the first end. The first end can be slidably connectable to the main rein, and the second end can be fixedly connectable to the saddle.

In another example, the elongated strap has a strap length, wherein at least a portion of the strap length is extensible to allow a horse head to freely move between a raised position and a resting position and wherein the rein keeper is graspable by a rider seated on the saddle.

DETAILED DESCRIPTION

The present disclosure provides examples of a rein keeper that can be used with horseback riding equipment (herein referred to as a "riding apparatus.") The rein keeper provides a safety feature that allows a rider 26 to maintain control of a horse 1 via the riding apparatus at most, if not all times (e.g., when riding, or when the horse 1 eats or drinks). The rein keeper is also non-intrusive such that it does not restrict a horse 1's movement. Rather, it allows for multiple degrees of freedom of movement of the horse's head 12.

Figure 1:
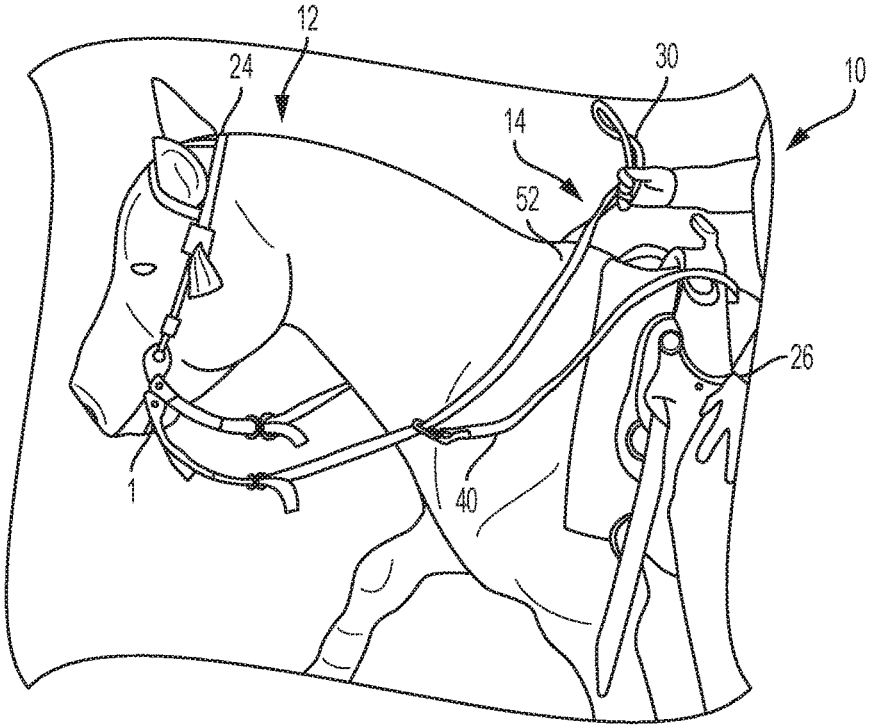
FIG. 1 is a top perspective of a horseback riding apparatus according to an embodiment with the horse's head shown in the riding position.
Figure 2:
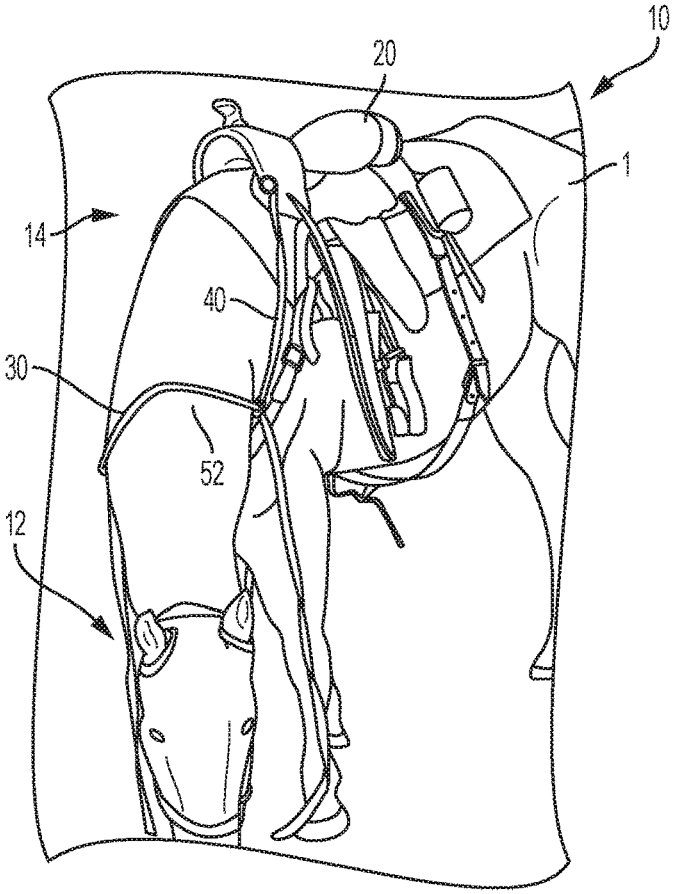
FIG. 2 is a front perspective of the riding apparatus of FIG. 1 with the horse's head shown in the resting position.

FIG. 1 shows a horse 1 wearing a riding apparatus 10 with the horse's head 12 in the riding position. As used herein, the term "riding position" may refer to a position where an end of the horse's head 12 is generally raised a distance above the ground. FIG. 2 shows the riding apparatus 10 with the horse's head 12 in the resting position. As used herein, the term "resting position" may refer to a position where an end of the horse's head 12 is at or near the ground (e.g., closer to the ground than the riding position). In some cases, the horse's head 12 is lowered all the way to the ground and in contact with the ground in the resting position (e.g., lowered while eating, drinking, and the like).

As seen from FIGS. 1 and 2, the riding apparatus 10 includes a saddle 20 to be mounted over a body of a horse 1 and a bridle 24 to be mounted over a head of the horse 1. The saddle 20 and bridle 24 include components generally well-known to one skilled in the art and a description thereof is omitted for brevity. A rider 26 may mount on the saddle 20 and grasp a main rein 30 connected to a head of the horse 1 and maneuver (e.g., steer) the horse 1 a desired direction. Thus, in some such embodiments, the main rein is a riding rein.

With continued reference to FIGS. 1 and 2, in certain embodiments, the main rein 30 comprises or consists of a non-extensible material. As used herein, the term "non-extensible" may refer to a material that does not significantly expand or contract during use (e.g., riding). For example, in some cases, the main rein 30 has a length and the length may be rigid or fixed and may not expand or contract when a rider 26 maneuvers the horse 1 in a preferred direction. In some cases, the main rein 30 comprises or consists of leather. In other cases, the main rein 30 comprises or consists of a non-stretchable fabric. For instance, the main rein 30 can be made of rope or leather.

Figure 3:
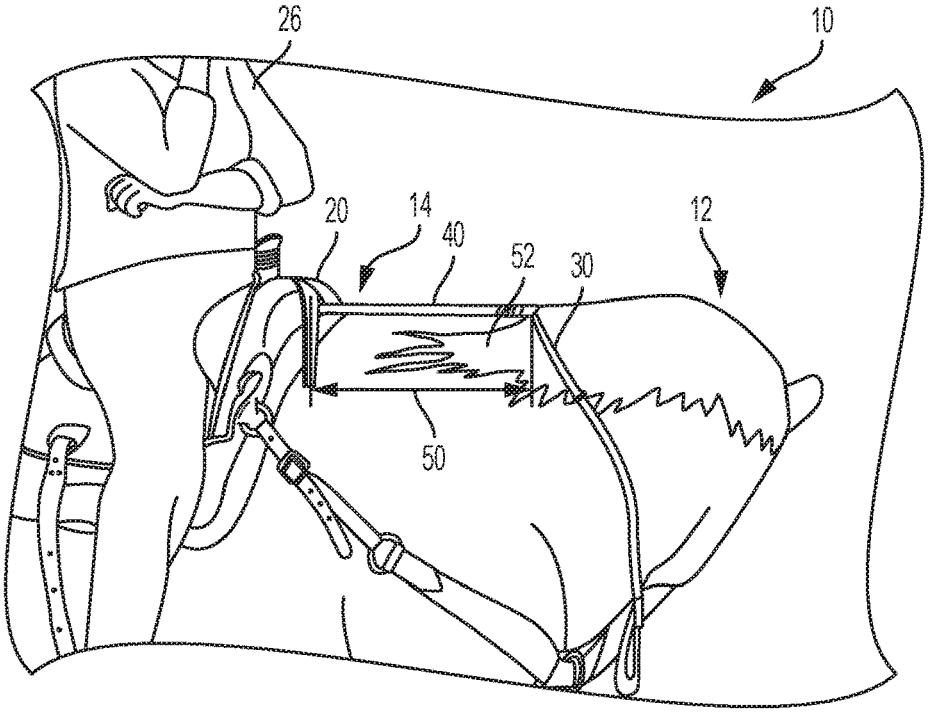
FIG. 3 is a side perspective view of the riding apparatus of FIG. 1 with the horse's head shown in the resting position.

As seen in FIG. 2 and referring now to FIG. 3, in certain preferred embodiments, the riding apparatus 10 includes a rein keeper 40. In some cases, the riding apparatus 10 includes only a single rein keeper 40. However, in some cases, the riding apparatus 10 includes two rein keepers 40, whereby each rein keeper 50 is attachable to the main rein 30 and is positioned on each (e.g., opposite) lateral side of the horse 1.

Figure 4:
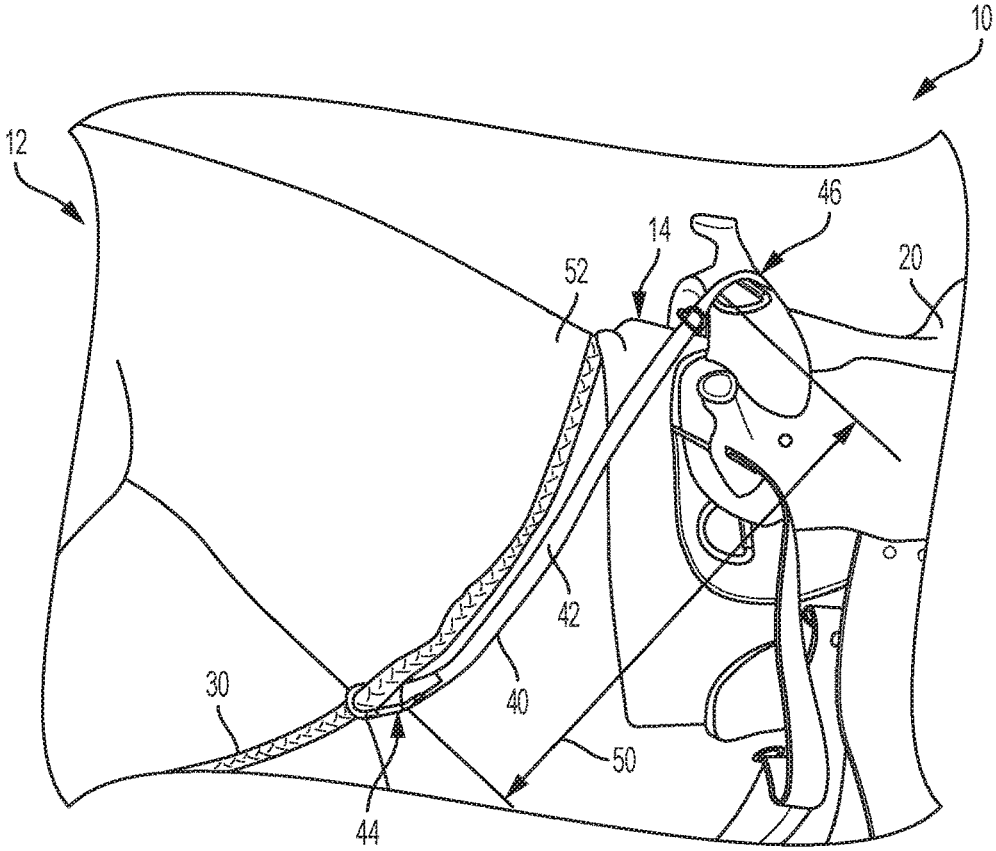
FIG. 4 is enlarged view of the riding apparatus of FIG. 1 illustrating some details of the rein keeper according to an embodiment.
Figure 5:
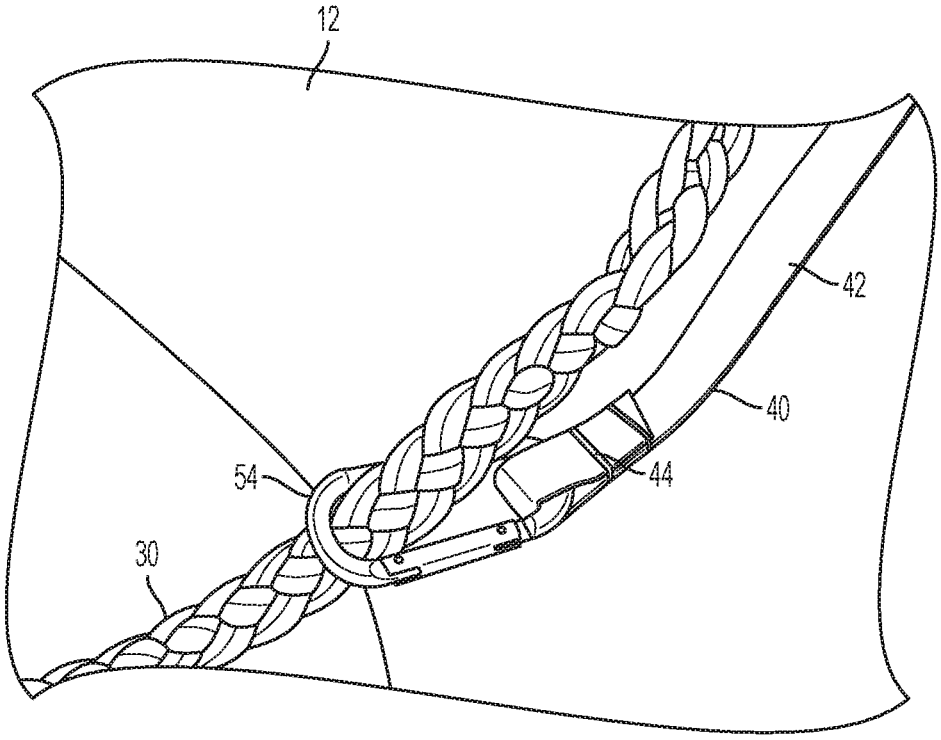
FIG. 5 is an enlarged view of a portion of the riding apparatus of FIG. 1, illustrating a first end of the rein keeper.

Referring to FIGS. 4 and 5, the rein keeper 40 includes, or is in the form of an elongated strap 42. The elongated strap 42 has a first end 44 and a second end 46 opposite to the first end 44. The first end 44 is attachable to the main rein 30 while the second end 46 is attachable to a portion of a saddle 20 (such as the pommel). The elongated strap 42 has a strap length 50 defined between the first end 44 and the second end 46.

The main rein 30 and the rein keeper 40 may either be separable or integrally formed. Further, in embodiments where the rein keeper 40 and the main rein 30 are integrally formed as a one-piece attachment, the rein keeper portion can be stretchable relative to the main rein portion. Alternatively, the rein keeper portion can be non-stretchable (e.g., and made of the same material as the main rein 30) and may be of a sufficient length to permit the rider to grasp the main rein 30 at any time without substantially restricting the movement of the horse's head.

In some cases, the rein keeper 40 is a "rein extender" and can extend to a desirable length so as to permit the main rein to be within the rider's reach most, if not at all times, while permitting the horse to move its head between the raised and the resting position. In such cases, the strap length 50 includes a portion that is extensible. For instance, the strap length 50 may not be a fixed, constant value, and may be variable (e.g., having a dynamic, non-fixed length) during use (e.g., between resting and riding positions). In some cases, the elongated strap 42 is substantially or entirely extensible over an entirety of the strap length 50. As used herein, the term "extensible" refers to a material that significantly expands or contracts, and thus may not have a fixed length. For instance, the strap length 50 may be substantially more extensible relative to the main rein 30. In some cases, the material is an elastic material. In other cases, the material is a stretchable material. In some embodiments, the material is a bungee cord. This extensible feature is advantageous in allowing the horse 1 to have unobstructed freedom of movement such that a horse 1 can raise or lower its head portion between its resting and riding positions shown in FIGS. 1 and 2.

With continued reference to FIGS. 4 and 5, as previously mentioned, in some cases, the elongated strap 42 can be a bungee cord. Bungee cords can be composed of one or more elastic strands braided or woven such that elastic strands spiral around a core. The elongated strap 42 extends longitudinally (along the strap length 50) when pulled, causing the elastic strands of the strap to squeeze the core, transmitting the core's elastic compression to the longitudinal extension of the strap. In some cases the elongated strap 42 is made of a material such that it is extensible to predetermined extended length. In such cases, the predetermined extended length can correspond to a distance moved by the horse's head 12 between a riding position and a resting position. In some such cases, the extended length can be between about 2 feet and 10 feet when the unextended (contracted) length is about 3 feet. The elongated strip has sufficient resiliency to provide a desired degree of extension and thereby permitting the horse's head 12 to move as desired.

The strap length 50 can be a length that allows the horse 1 to freely move its head between a riding position and a resting position. In some cases, the strap length 50 can be between about 1 foot and 5 feet in an unextended state. In one example, the strap length 50 is between about 3.5 feet and about 4 feet in the unextended state.

Referring back to FIG. 4, the rein keeper 40 is connectable at its first end 44 to the main rein 30 at any point along the main rein length. Referring again to the enlarged view of FIG. 5, which illustrates details of the first end 44, the rein keeper 40 and the main rein 30 can be connectable such that the first end 44 of the elongated strap 42 and the main rein 30 are slidable relative to each other. In some cases, the first end 44 of the rein keeper 40 comprises a first connector 54 through which the main rein 30 loops. Also, the rein keeper 40 can attach to the main rein 30 such that the rein keeper 40 is slidable along a substantial portion of the main rein length of the main rein 30. For instance, the rein keeper 40 can attach to the main rein 30 such that the rein keeper 40 is slidable along the entire main rein length. In other words, the rein keeper 40 is slidably connected to the main rein 30.

As seen from FIG. 5, in some examples, the first end 44 can include an O-ring or carabiner and the main rein 30 extends through the O-ring or carabiner. Other suitable connectors that allow the rein keeper 40 to slidably connect to the main rein 30 are also contemplated. In some cases, the O-ring or carabiner includes an inside opening having a smallest diameter and the main rein 30 includes a maximum circumference or a maximum width, wherein the O-ring/carabiner smallest diameter is larger than the main rein 30 maximum circumference or maximum width. This allows for the main rein 30 to slide through the O-ring or carabiner in a free-flowing fashion, which in turn allows the rein keeper 40 to slidably move along the main rein 30. This slidable feature is also advantageous in allowing the horse 1 to have unobstructed freedom of movement.

While examples illustrated herein provide a freely slidable rein keeper 40 that can slide relative to the main rein 30, it should be noted that in other examples, the rein keeper 40 can instead be attached (e.g., by Velcro, sewing, snap closure or other attachment techniques) to the main rein 30. In such cases, it would be advantageous to attach the rein keeper 40 away from the horse's mouth so as to permit freedom of movement of the horse's head, while still permitting access to the main rein 30 in case the rider were to drop it. Further, in some such cases, the rein keeper 40 can be of a non-stretchable or non-elastic material (such as rope or leather), but can be of a sufficient length (e.g., 3 feet, 5 feet and the like) so as to connect between a top portion of the horse, and permit the horse to raise or lower its head. For instance, the rein keeper 40 can be fixedly attached to the main rein at a top portion of the horse away from the horse's mouth. For instance, the rein keeper 40 can be fixedly (non-slidably) attached to the main rein 30 at a position corresponding to the horse's crest 52, so that when the rider grasps the rein keeper 40 to take control of the main rein 30, such a movement may not injure the horse (for instance, by pulling at the horse's mouth). Such embodiments advantageously protect the horse as well as the rider in the event that the rider drops the main rein.

Figure 6:
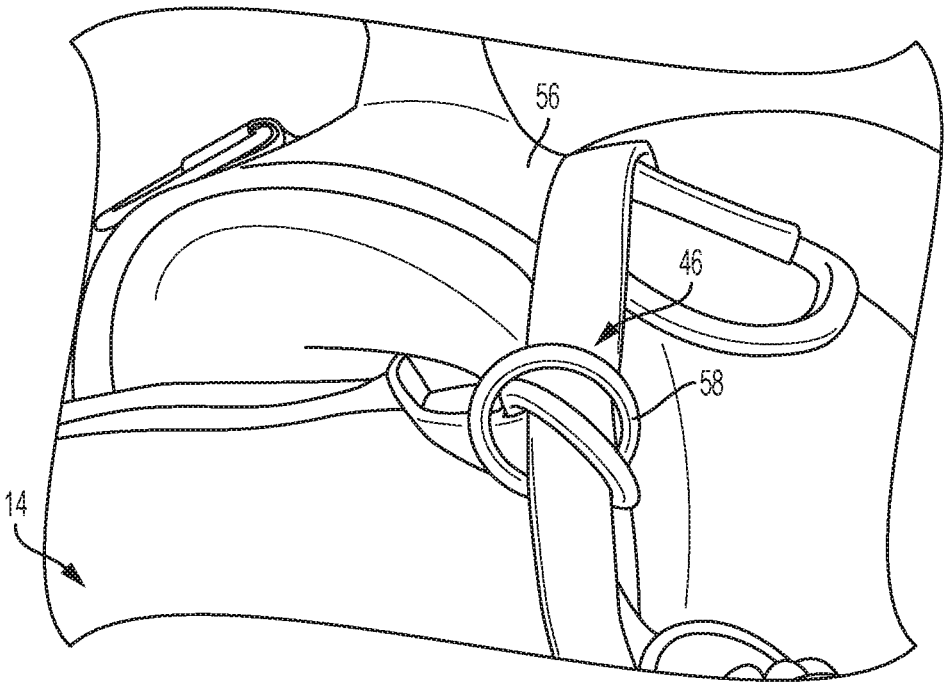
FIG. 6 is a close-up view of a portion of the riding apparatus of FIG. 1, illustrating a second end of the rein keeper.

In the embodiment of FIGS. 5 and 6, the connector is a carabiner 54. The carabiner 54 is clipped around the main rein 30 such that the first end 44 of the rein keeper 40 can slide along the main rein length of the main rein 30. The carabiner 54 can be sized such that the main rein 30 flows freely through its inside opening. In one example, the carabiner 54 has an inside opening with a smallest diameter of about 1.5 inches and the main rein 30 has a maximum circumference that is less than 1.5 inches.

Figure 7:
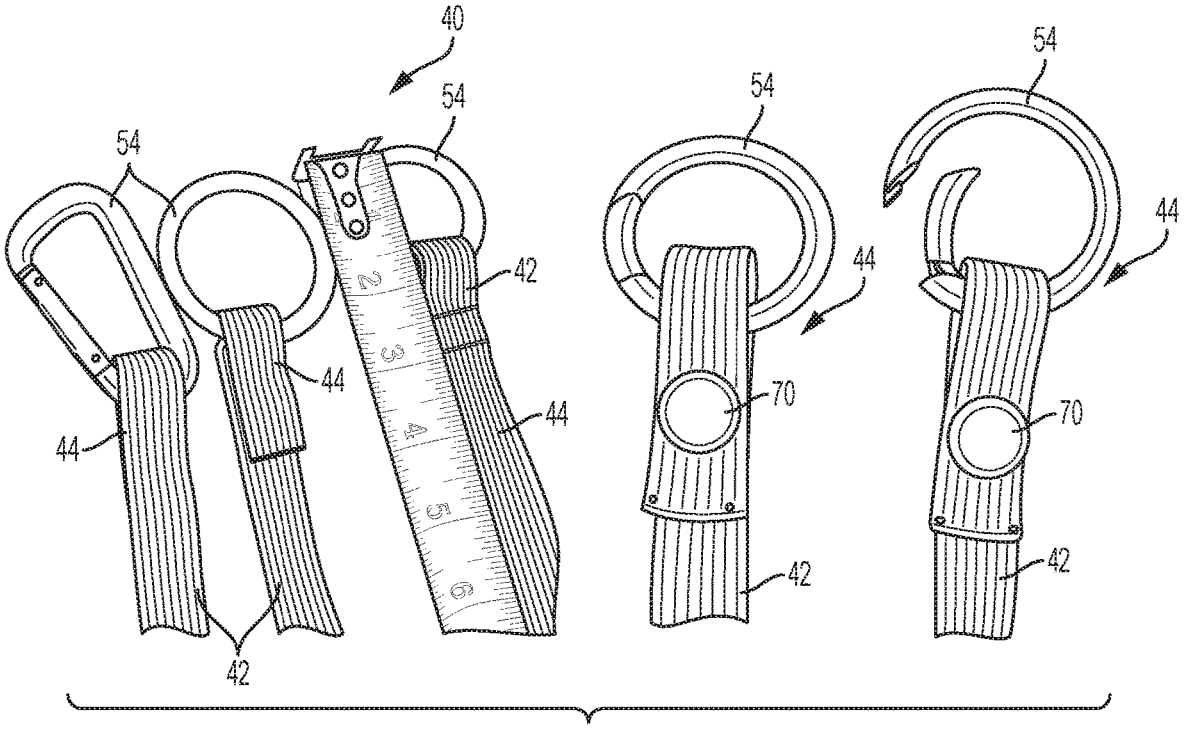
FIG. 7 is an enlarged view of the first end of various types of rein keepers according to an embodiment.

FIG. 7 illustrates various types of connectors that are suitable for the first end 44 of the rein keeper 40. In some alternative examples, instead of a carabiner, the connector is an O-ring. In such cases, the main rein 30 is looped through the opening of the O-ring 54. The O-ring 54 can be sized such that the main rein 30 flows freely through its inside opening. In one example, the O-ring connector has an inside diameter of about 1 inch and the main rein 30 has a maximum circumference that is less than 1 inch. While a carabiner and O-ring are illustrated, as noted previously, the rein keeper 40 can be fixedly connected to the main rein 30 by a snap or button closure, sewed on to the main rein, attached by Velcro, or have a loop at the end and the like.

Referring back to FIG. 6, the elongated strap 42 comprises a second end 46. The second end 46 can include a second connector 58 that is connectable to a front portion 56 of the saddle 20. In some cases, the front portion 56 is a pommel. Various types of connectors such as a D-shaped carabiner, clips, snap closure or other fasteners can be used to connect (e.g., either fixedly or slidably or adjustably connect) the second end 46 to one or more locations on the saddle 20. In some cases, connection between the second end 46 and the saddle 20 is fixed (e.g., non-slidable relative to each other). Thus, in some cases, the second end 46 of the elongated strap 42 of the rein keeper 40 is fixedly connected to the saddle 20 permit a rider 26 to grasp the rein keeper 40 while the first end 44 is slidably connected to the main rein 30 permit some slack and/or degree of freedom for the horse's head 12. Alternatively, the second end 46 and the saddle 20 is adjustably connected to portions of the saddle 20, for instance, in a manner similar to the connections of the first end 44 with the main rein 30.

Figure 8A:
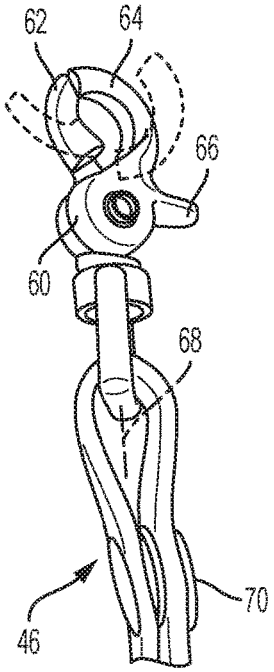
FIG. 8A is an enlarged view of the second end of an example rein keeper according to an embodiment.
Figure 8B:
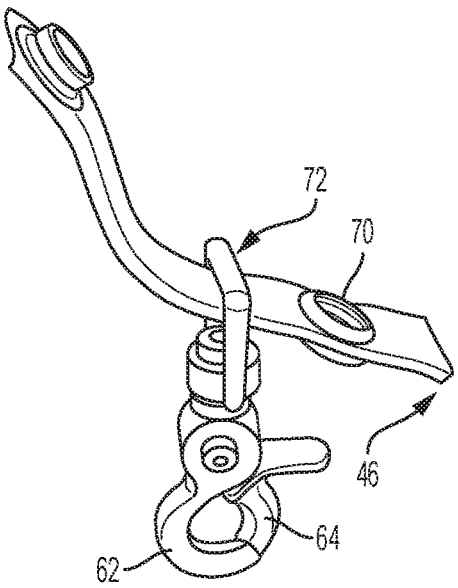
FIG. 8B is an enlarged view of the second end of the rein keeper of FIG. 8A.

FIGS. 8A and 8B illustrate the second end 46 of an exemplary rein keeper 40. In this example, the second end 46 includes a swivel hook 60. The swivel hook 60 can have jaws 62, 64 that are shown in the closed position but can open radially outwardly (as shown by the dotted lines) by pressing against the tab 66. The swivel hook 60 can be spring-biased such that when pressure is no longer applied against the tab 66, the jaws 62, 64 return to the closed position. In such examples, the second end 46 can be connected to portions of the saddle 20 (e.g., pommel) by attaching the swivel hook 60 at a suitable location (e.g., a loop, ring, or other location on the saddle 20. As is apparent to one skilled in the art, the swivel hook 60 can permit swivel thereof about its center axis 68.

In some examples, the first connector 54 and the second connector 58 can each be removably connected to the elongated strap 42. In addition, the first connector 54 and the second connector 58 can each be permitted to have limited sliding motion with respect to the elongated strap 42. For instance, with continued reference to FIG. 8A, the elongated strap 42 includes a button clasp 70 near the second end 46. As is apparent, the swivel hook 60 can be removed and/or disconnected by disengaging the button clasp 70. For instance, if a rider 26 prefers to use O-rings on both the first end 44 and the second end 46, the user may remove the existing connector (e.g., by disengaging the button clasp 70 as shown in FIG. 8B), and remove the swivel hook 60 from the elongated strap 42. As is appreciable, the swivel hook 60 has an opening 72 with an opening size greater than the width of the elongated strap 42, such that the swivel hook 60 can slide along the length of the elongated strap 42. During use, however, the button clasp 70 is closed, and the swivel hook 60 has limited sliding motion on the elongated strap 42. While a button clasp 70 is illustrated, other types of removable fasteners can be provided.

Figure 9B:
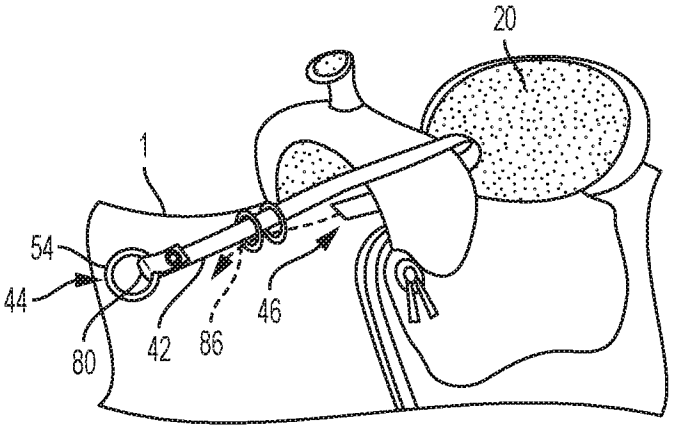
FIGS. 9A, 9B, 9C and 9D illustrate the steps of attaching an exemplary rein keeper to an exemplary riding apparatus.
Figure 9D:
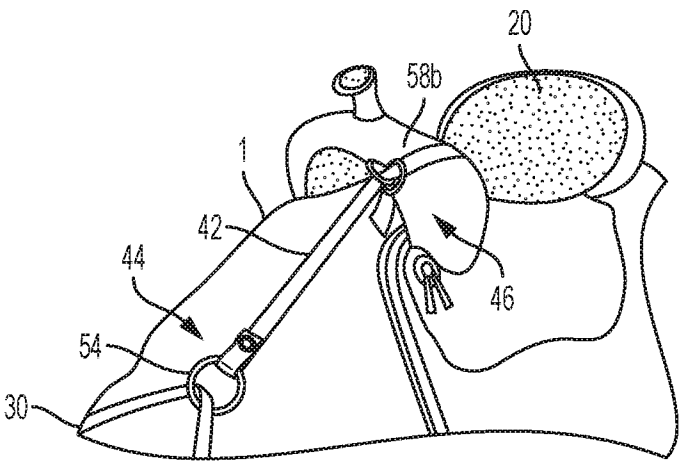
Figure 9A:
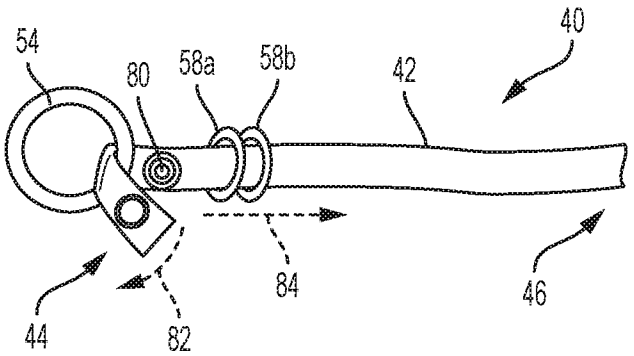

FIGS. 9A, 9B, 9C and 9D illustrate attaching a rein keeper 40 to a riding apparatus 10 similar to those illustrated in FIGS. 1-6. As described above, the first connector 54 (in this example, an O-ring) is removably and/or slidably connected to the elongated strap 42. The second connector 58 (in this example, also a pair of O-rings) is removably and/or slidably connected to the elongated strap 42. A button clasp 80 is provided on the first end 44. Initially, the first connector 54 and the second connector 58 are both positioned near the first end 44 as shown in FIG. 9A.

Figure 9C:
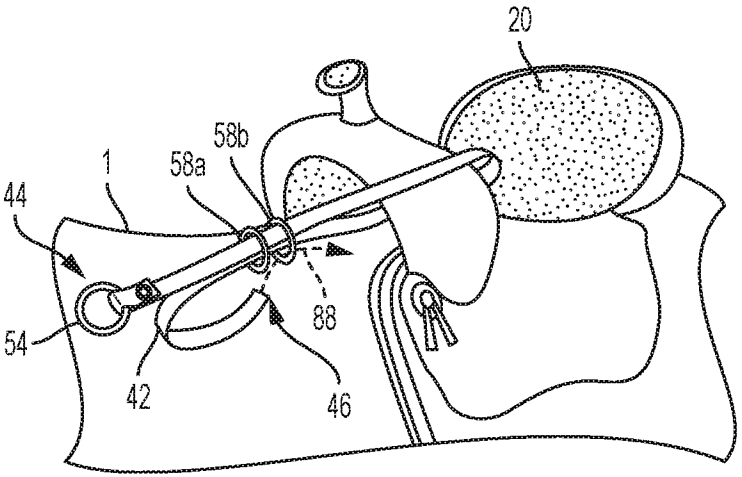

To connect the second end 46 to the saddle 20 (e.g., pommel), referring to FIG. 9B, the second connector 58 can be removed from the first end 44, by disengaging the button clasp 80 (as shown by arrow 82), and sliding the second connector 58 toward the second end 46 (as shown by arrow 84). Next, the second end 46 of the elongated strap 42 can be looped around at least a portion of the saddle 20, as shown in FIG. 9B. Once the elongated strap 42 loops around the saddle 20, the second end 46 can be brought toward the second connector 58, in a direction shown by arrow 86. In the present example, the second connector 58 is a pair of O-rings 58*a* and 58*b*, and the second end 46 can be looped back into both O-rings as shown in FIG. 9C. Next, as seen in FIG. 9C, the second end 46 can be looped through one of the two O-rings 58*b*, as shown by the arrow 88. Finally, by pulling the second end 46 out of the second O-ring 58*b*, the elongated strap 42, and in turn the rein keeper 40 can be rigidly (and/or non-slidingly) connected to a portion of the saddle 20. As shown in FIG. 9D the first connector 54 can be slidably attached to the main rein 30 as described previously. As seen from FIG. 9D, when the horse 1 lowers its head, the main rein 30, attached thereto may move away from the saddle 20, but because the rein keeper 40 includes portions that are substantially stretchable, the elongated strap 42 may extend between its fixed (and/or non-sliding) second end 46, and the freely-sliding first end 44. As is apparent, the rein keeper 40 may be within the rider 26's reach, and the rider 26 may use the rein keeper 40 to pull the main rein 30 toward them.

The unique features of the rein keeper 40 allows for the horse 1 to have freedom of movement of its head while at the same time keeping the main rein 30 connected to a portion of the saddle 20. The rein keeper 40 may be readily graspable by a rider 26 seated on the saddle 20. If the rider 26 loses the main rein 30 (which can happen if the horse 1 trips or falls while riding or if the horse 1 spooks and moves its head unexpectedly), the rider 26 can grasp the rein keeper 40 and thereby pull the main rein 30 towards the saddle 20 and thus grasp and regain control of the main rein 30. Advantageously, the rider 26 may not have to change his/her balance much while retrieving the main rein 30 and may safely regain control of the horse 1. Further, the rein keeper 40 may allow the rider to grasp the main rein 30 without causing injury or discomfort to the horse.

Various examples have been described.

The invention claimed is:

1. A horseback riding apparatus comprising:

a saddle;

a main rein attached to a bridle at one end and configured for maneuvering a horse at another end; and a rein keeper attached to the main rein and the saddle, the rein keeper comprising:

an elongated strap having a first end and a second end opposite to the first end, the first end including a connector that is slidably and directly connected to the main rein such that the first end slides along the main rein, and the second end being fixedly and directly connected to the saddle at a location readily graspable by a rider seated on the saddle, such that the second end remains fixed on the saddle.

2. The apparatus of claim 1, wherein the connector at the first end comprises a first connector having an opening, wherein the opening is sized and shaped to slidably receive the main rein.

3. The apparatus of claim 2, wherein the first connector is an O-ring, wherein the opening of the O-ring has a diameter large enough to slidably receive the main rein.

4. The apparatus of claim 2, wherein the first connector is a carabiner, wherein the opening of the carabiner has a diameter large enough to slidably receive the main rein.

5. The apparatus of claim 1, wherein the elongated strap has a strap length between the first end and the second end, wherein at least a portion of the strap length is extensible to allow a horse to freely move its head between a raised position and a resting position.

6. The apparatus of claim 5, wherein substantially the entire strap length is extensible such that the rein keeper does not pull the horse's head when the rider grasps the main rein using the rein keeper.

7. The apparatus of claim 1, wherein the elongated strap is a bungee cord.

8. The apparatus of claim 1, wherein the second end comprises a second connector fixedly attached to a portion of the saddle in a non-sliding manner, the second connector being one of a carabiner, a pair of O-rings, and a swivel-hook.

9. The apparatus of claim 1, wherein the rein keeper is of adjustable length.

10. The apparatus of claim 1, wherein the first end is slidably connected to the main rein along a location of the main rein spaced from the bridle.

11. A horseback riding apparatus comprising:

a main rein attached to a bridle at one end and configured for maneuvering a horse at another end; and a rein keeper attachable to the main rein, the rein keeper comprising:

an elongated strap having a first end and a second end opposite to the first end, the first end being directly connected to the main rein and the second end being directly connected to a pommel of a saddle, wherein the first end includes a first connector having an opening receiving the main rein such that the first end slides along the main rein, and the second end includes a second connector fixedly connectable to the saddle, such that the second end remains fixed on the saddle, wherein the elongated strap has a strap length between the first end and the second end, wherein at least a portion of the strap length is extensible to allow a horse head to freely move between a raised position and a resting position, the rein keeper being connectable to the main rein to permit a rider to grasp the main rein without pulling a horse's head.

12. The apparatus of claim 11, wherein at least a portion of the strap length is extensible to a predetermined extended length corresponding to a distance moved by a horse head between a riding position and a resting position.

13. The apparatus of claim 12, wherein the rein keeper is of a length of about between about 1 foot and about 5 feet in an unextended state, and is of a length of between about 2 feet and about 10 feet in an extended state.

14. The apparatus of claim 11, whereby the horseback riding apparatus includes only a single rein keeper that extends along a single lateral side of a horse.

15. A horseback riding apparatus comprising:

a main rein connectable to a horse's head proximal to the horse's mouth at one end and configured for maneuvering the horse at another end; and a rein keeper attached to a main rein, the rein keeper comprising:

a strap having a first end and a second end opposite to the first end, the first end including a connector that is slidably and directly connected to the main rein such that the first end slides along the main rein and the second end is directly connected to a pommel of a saddle, wherein the strap has a strap length sufficient to allow a horse head to freely move between a raised position and a resting position, the rein keeper being connected to the main rein at a position away from the horse's mouth so to permit a rider to grasp the main rein without pulling the horse's head.

16. The apparatus of claim 15, wherein the rein keeper is made of rope or leather.

17. The apparatus of claim 15, wherein the strap length is about 3 feet in an unextended state.

18. The apparatus of claim 15, wherein the entirety of the rein keeper is non-stretchable.

19. The apparatus of claim 15, wherein the first end is slidably connected to the main rein along a location of the main rein spaced from the bridle.

* * * * *